US005393220A

United States Patent [19]

Couwels et al.

[11] Patent Number: 5,393,220

[45] Date of Patent: Feb. 28, 1995

[54] COMBUSTION APPARATUS AND PROCESS

[75] Inventors: Ludo J. C. Couwels, Oelegem-Ranst; Eddy J. A. Lauwers, Kalmthout, both of Belgium

[73] Assignee: Praxair Technology, Inc., Danbury, Conn.

[21] Appl. No.: 161,519

[22] Filed: Dec. 6, 1993

[51] Int. Cl.[6] ..... F23M 3/04

[52] U.S. Cl. ..... 431/10; 110/238; 239/434.5; 431/160; 431/187

[58] Field of Search ..... 239/419.3, 425, 434.5; 431/8, 10, 160, 187; 110/264, 263, 238

[56] References Cited

U.S. PATENT DOCUMENTS

| | | | |
|---|---|---|---|
| 4,065,057 | 12/1977 | Durmann | 239/425 X |
| 4,575,332 | 3/1986 | Oppenberg et al. | 431/9 |
| 4,907,961 | 3/1990 | Anderson | 431/8 |
| 5,104,310 | 4/1992 | Saltin | 431/10 |
| 5,127,346 | 7/1992 | Kepplinger et al. | 431/160 X |
| 5,129,333 | 7/1992 | Frederick et al. | 110/235 |
| 5,149,261 | 9/1992 | Suwa et al. | 431/160 X |
| 5,188,042 | 2/1993 | Lauwers | 110/346 |

OTHER PUBLICATIONS

Brazilian Patent Application No. 8503088, "Process for Combustion of Combustible Material", Wilfried Lissack et al. Mar. 11, 1986, (translation provided).

*Primary Examiner*—Edward G. Favors
*Attorney, Agent, or Firm*—Chung K. Pak; Stanley Ktorides

[57] ABSTRACT

Processes and apparatus for combusting fluid fuel, e.g., liquid fuel, in at least two combustion zones, wherein the fluid fuel is partially combusted with a fluid fuel atomizing or dispersing fluid containing oxygen in an initial combustion zone and is completely combusted with oxidant in at least one subsequent combustion zone.

15 Claims, 2 Drawing Sheets

COMBUSTION APPARATUS AND PROCESS

TECHNICAL FIELD

The present invention relates to an apparatus useful for combusting fluid fuel, e.g., liquid fuel, and the process for carrying out the same.

BACKGROUND OF THE INVENTION

Various burners have been used in industrial furnaces to melt glass forming ingredients or metals, to incinerate waste or to combust chemical reactants. Generally, these burners comprise a passageway for ejecting fuel and a passageway for emitting oxidant, as shown by, for example; U.S. Pat. No. 5,104,310 and Brazilian Patent No. 8,503,088. The fuel is normally atomized with pressurized air, pressurized steam or mechanical fuel atomizing means and combusted with a substantial amount of oxidant. When the oxidant employed is either an oxygen enriched air or technically pure oxygen rather than air, the combustion efficiency may be enhanced. Much less energy, for example, may be needed for handling oxygen enriched air or pure oxygen since oxygen enriched air or pure oxygen contains less inert nitrogen than does air for an equivalent amount of oxygen. However, the pure oxygen or oxygen enriched air is known to increase the combustion temperature. Thus, failure to control the combustion temperature and flame length resulting from using the pure oxygen or oxygen enriched air can damage the burners and/or their associated furnaces. Moreover, an unsafe condition may be created if fuel, such as oil, is allowed to flow into a passageway which is used for emitting oxidant. The oil in the oxygen pipe, for example, can lead to an explosion since it can be ignited in the presence of oxygen. Therefore, there is a genuine need for apparatus and processes, which are useful for mitigating or alleviating such problems.

SUMMARY OF THE INVENTION

One aspect of the present invention relates to a process for controlling the combustion temperature and flame length produced by a burner through combusting fluid fuel in at least two combustion zones. This combustion process comprises:

(a) ejecting at least one fluid fuel stream through at least one first outlet opening;

(b) ejecting a fluid fuel atomizing or dispersing fluid containing oxygen at an angle to the flow direction of said at least one fluid fuel stream through at least one second outlet opening;

(c) atomizing or dispersing said at least one fluid fuel stream with said fluid fuel atomizing or dispersing fluid containing oxygen within a chamber;

(d) partially combusting said fluid fuel stream with said fluid fuel atomizing or dispersing fluid containing oxygen in said chamber;

(e) ejecting at least a stoichiometric amount of oxidant through at least one third opening located at a zone downstream of said chamber; and (f) combusting the partially combusted fluid fuel with said oxidant in said zone downstream of said chamber.

Another aspect of the present invention relates to a burner capable of burning fluid fuel, more particularly liquid fuel, in at least two combustion zones. The design of the burner is such that it is capable of minimizing the risk associated with the flow of fluid fuel, such as oil, into oxygen emitting passageways and is capable of maintaining a desired flame length. The burner comprises:

a) an elongated body having at least one inner passageway terminating with at least one first outlet port, said at least one first outlet port being capable of ejecting fluid fuel atomizing or dispersing fluid containing oxygen at an angle with respect to the central axis of said elongated body and having a cross-sectional area smaller than the cross-sectional area of said at least one inner passageway;

b) a first housing means surrounding and extending beyond the length of said elongated body to form a chamber downstream of said at least one first outlet port and to form a first annular passageway therebetween for passing fluid fuel into said chamber, said chamber being capable of accommodating at least partial combustion of fluid fuel; and c) a second housing means surrounding said first housing means to form a second annular passageway therebetween for introducing oxidant downstream of said chamber for further combustion of fluid fuel.

At least one first outlet port comprises a plurality of bores at an angle with respect to the central axis of the elongated body. The first annular passageway furnished between the interior wall surface of the first housing means and the outer wall surface of the elongated body can be used to eject fluid fuel into the chamber. The first annular passageway may be terminated with at least one second outlet port defined by at least one groove on the outer wall surface of said elongated body. At least one groove may be a plurality of spiralling grooves on the outer surface of the elongated body to provide swirling fluid fuel into the chamber. The chamber formed by the first housing means and the second annular passageway formed by the second housing means may be expanded obliquely toward their discharge end openings in the form of a trumpet-end or a cone to prevent fluid fuel, such as oil, from accumulating inside of the chamber and/or the second annular passageway. By allowing the fluid fuel, such as oil, to flow out of the chamber and the second annular passageway, the fluid fuel is prevented from entering both the inner passageway and the second annular passageway, thus reducing the risk associated with ignition and possibly explosion due to reaction between the fluid fuel and oxygen within the passageways.

As used herein, the term "a substantially homogeneous mixture" or "homogeneous mixture" means a thoroughly, uniformly or well mixed mixture containing fluid fuel and a fluid fuel atomizing or dispersing fluid containing oxygen.

As used herein, the term "a plurality of bores" or "a plurality of grooves" means two or more bores or grooves.

As used herein, the term "at least one outlet port", "at least one bore" or "at least one groove" means one or more outlet ports, bores or grooves.

DETAILED DESCRIPTION OF THE INVENTION

One aspect of the present invention lies in combusting fluid fuel in at least two combustion zones wherein the fluid fuel is partially combusted with a fluid fuel atomizing or dispersing fluid containing oxygen, e.g., high velocity oxygen enriched air or pure oxygen, in an initial combustion zone and then is combusted with at least a stoichiometric amount of oxidant in at least one subsequent combustion zone. Initially, the fluid fuel atomizing or dispersing fluid containing oxygen, e.g., high velocity oxygen or oxygen enriched air, is ejected at an angle with respect to the flow direction of the ejected fluid fuel stream to atomize or disperse the fluid fuel stream. The atomization or dispersement of the fluid fuel caused by the fluid fuel atomizing or dispersing fluid containing oxygen is such that a substantially homogenous mixture, e.g., a thoroughly mixed mixture or a well mixed mixture containing both the fluid fuel and the fluid fuel atomizing fluid containing oxygen, is formed. The formation of the substantially homogeneous mixture causes the fluid fuel in the mixture to be partially combusted with the fluid fuel atomizing or dispersing fluid containing oxygen. This partial combustion of the fluid fuel is carried out in a chamber available within the burner, without a substantial amount of oxygen. During the combustion, the volumetric rate of the fluid fuel atomizing or dispersing fluid containing oxygen employed may be adjusted or regulated to obtain the desired combustion temperature and the desired flame length. The adjustment, for example, can be made based on the transmitted and/or monitored temperature or flame conditions.

The partially combusted fluid fuel is further combusted with at least a stoichiometric amount of oxidant in at least one subsequent combustion zone. The subsequent combustion zone is located outside of the burner to minimize damage to the burner due to the high temperature resulting from the subsequent combustion.

The advantages of this combustion process lie in, among other things, utilizing the energy generated by the fluid fuel atomizing or dispersing fluid, enhancing dispersement and combustion of the fluid fuel and reducing the combustion temperature involved. These advantages are attained along with the reduced $NO_x$ formation, the desired flame pattern and length and the improved life of the burner.

Another aspect of the present invention lies in particularly designed burners which are capable of carrying out the above combustion process. The burners may have additional features which are useful for reducing or preventing the flow of fluid fuel, such as oil or other liquid fuel, into the outlet for ejecting the fluid fuel atomizing or dispersing fluid containing oxygen and the outlet for ejecting oxidant.

Figure 1:
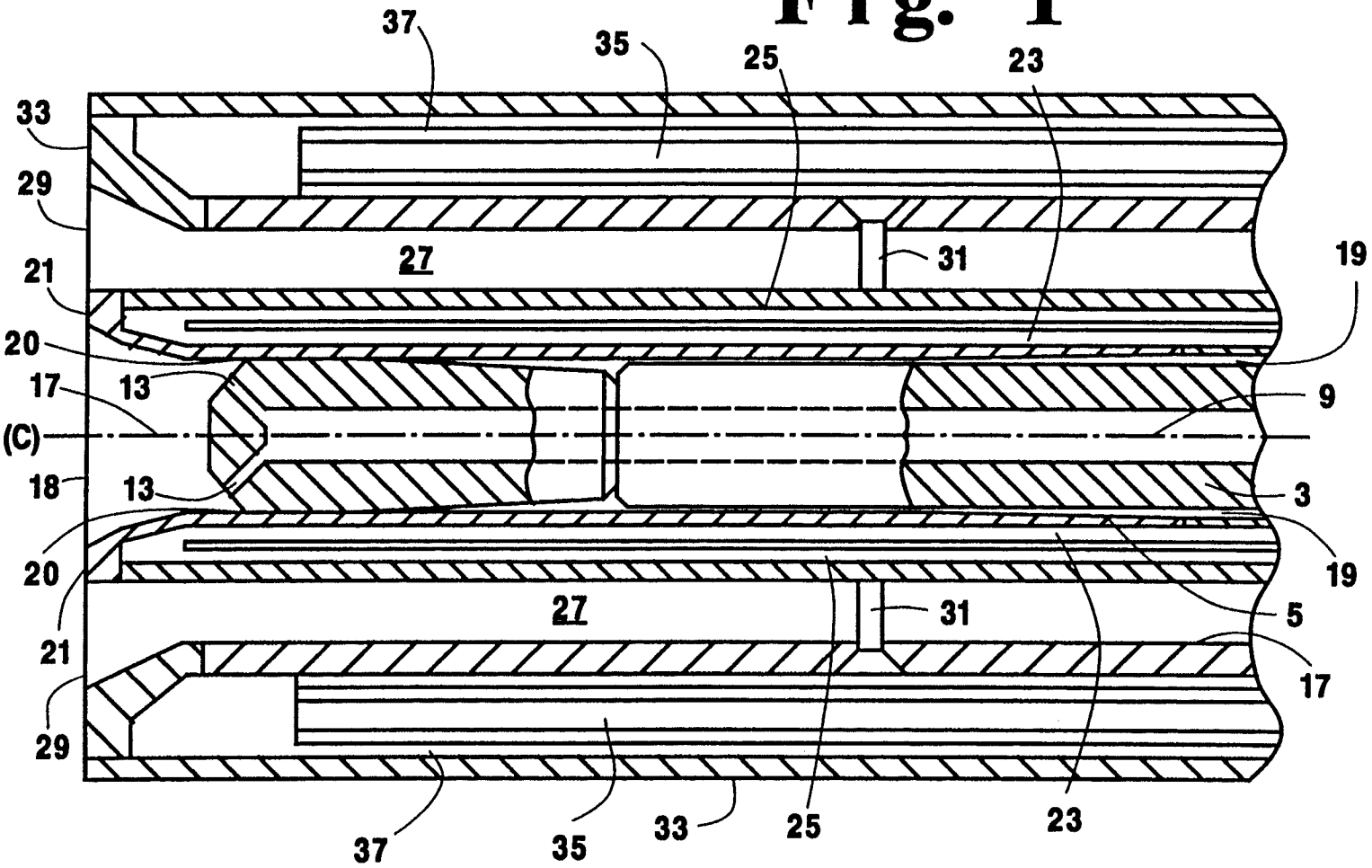
FIG. 1 is a schematic cross-sectional view of the frontal section of a burner according to one embodiment of the invention.
Figure 2:
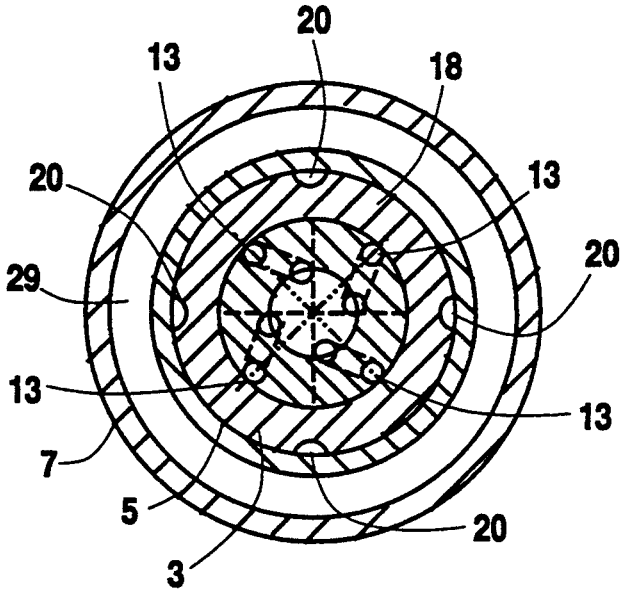
FIG. 2 is a front view of the burner shown in FIG. 1.
Figure 3:
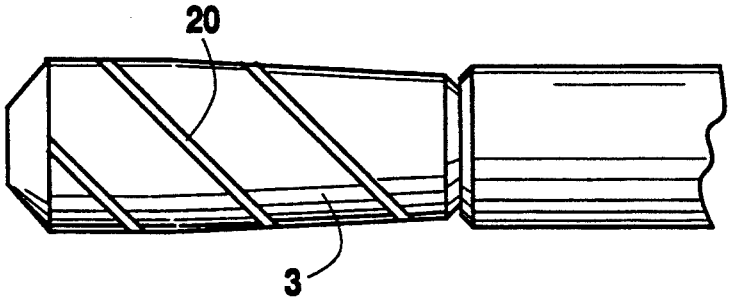
FIG. 3 is a cross-sectional view of spiralling grooves on the outer surface of an elongated body (nozzle assembly), which is another embodiment of the invention.

The preferred embodiment of the invention is described in reference to FIGS. 1–3, drawn to a specific burner. The preference for this embodiment, however, in no way precludes numerous variations of this embodiment which will become apparent or obvious to one of ordinary skill in the art. As illustrated by FIGS. 1 and 2, the burner comprises, among other things, an elongated body (3), a first housing means (5) and a second housing means (7). The elongated body (3) and housing means (5 and 7) may be cylindrical and may be made with various high temperature, chemical and corrosion resistant materials, such as nickel and high nickel alloys sold under the trademark "MONEL ®", "INCONEL ®" or "INCOLY ®". These high nickel alloys generally contain about 30 to 80% nickel by weight, about 0 to 50% iron by weight, about 0 to 50% chromium by weight and optionally about 0.5 to 35% by weight of other metals, such as titanium, copper, aluminum, cobalt and/or molybdenum. The percentage of iron or chromium is preferably varied from about 1 to 48% by weight.

The elongated body (3), a nozzle assembly, has at least one inner passageway (9) terminating with at least one first outlet port (13). The first outlet port (13) has a cross-sectional area smaller than the cross-sectional area of the inner passageway. The first outlet port (13) may be defined by a plurality of bores which are directed at an angle with respect to the central axis (c) of the elongated body (3). The first outlet port (13) may also be radially spaced from the central axis (c) of the elongated body (3).

The first housing means (5) surrounds and extends beyond the length of the elongated body (3) to form a combustion chamber (17) and a first annular passageway (19). The combustion chamber (17) is located in front of or downstream of the first outlet port (13) while the first annular passageway (19) is located between the interior wall surface of the first housing means (5) and the outer wall surface of the elongated body (3). The first annular passageway (19) may be terminated with at least one second outlet port (20). The second outlet port (20) may be defined by a plurality of spiralling grooves which are formed on the outer surface of the elongated body (3), as shown by FIG. 2. The second outlet port (20) having a cross-sectional area or diameter smaller than the cross-sectional area or diameter of the annular passageway (19) is in fluid communication with the combustion chamber (17). The combustion chamber (17) may be defined by having an internal wall surface in the form of a cone or a trumpet end. In other words, the discharge end section of the first housing means (5) is flared outwardly away from the longitudinal axis of the first housing means, e.g., at an angle ranging from about 10° to about 30°.

On the outer surface of the first housing means (5), a cooling jacket (21) may be provided. The cooling jacket (21) comprises at least one first compartment (23) for receiving coolant from a source outside of the cooling jacket (21) and at least one second compartment (25) for receiving and discharging the coolant from the first compartment (23). The cooling jacket (21) covers at least a portion of the first housing means, e.g., at least a portion of the first housing means forming the combustion chamber (17). The jacket or compartments may be made with stainless steel or high nickel alloys to prevent corrosion within the jacket or compartments.

The second housing means (7), which may be coupled to the cooling jacket (21) or the first housing means (5) by at least one spacer or other coupling means (31), surrounds the cooling jacket (21) or the first housing means (5) to form a second annular passageway (27) therebetween. The discharge end section of the second housing means (7) has an internal wall surface in the form of a cone or a trumpet end. Such an internal wall surface may be obtained by flaring the discharge end section of the second housing means (7) outwardly away from the longitudinal axis of the second housing means (7). The discharge end section of the second housing means (7) at least partially should cover or surround the combustion chamber (17) so that any liquid or oil dripping from the combustion chamber (17) is prevented from entering the second annular passageway (27).

On the outer surface of the second housing means (7), a cooling jacket (33) may be provided. The cooling jacket (33) comprises at least one first compartment (35) for receiving coolant from a source outside of the cooling jacket (33) and at least one second compartment (37) for receiving and discharging the coolant from the first compartment (35). The cooling jacket (33), covers at least a portion of the second housing means in the vicinity of the discharge end opening (29), e.g., a portion of the second housing means covering the combustion chamber (17) which is formed by the first housing means (5). The jacket or compartments may be made with stainless steel or high nickel alloys to prevent corrosion within the jacket or compartments.

To operate the burner, fluid fuel, such as oil, other liquid fuel or liquid waste having a heating value of about at least 3000 K cal/Kg, is delivered at a pressure of about 2 barg to about 6 barg to the first annular passageway (19) from a fluid fuel source (not shown). The fluid fuel delivered to the first annular passageway is ejected from the second outlet port (20). The second outlet port (20) may have a cross-sectional area smaller than the first annular passageway (19) to increase the velocity of the fluid fuel ejected therefrom. The second outlet port (20) is preferably a plurality of spiralling grooves which are capable of imparting the whirling or swirling effect to the fluid fuel. The spiralling grooves promote dispersement and combustion of the fluid fuel.

In the meantime, the fluid fuel atomizing or dispersing fluid containing oxygen, such as oxygen enriched air or pure oxygen, is fed at a pressure of about 2 barg to about 6 barg to the inner passageway (9) from a source containing the fluid fuel atomizing or dispersing fluid (not shown). The fluid fuel atomizing or dispersing fluid containing oxygen fed to the inner passageway (9) is ejected from the first outlet port (13), such as a plurality of bores. The fluid fuel atomizing or dispersing fluid containing oxygen is directed at an angle to the flow direction of the fluid fuel, thus intersecting and dispersing the fluid fuel. The first outlet port (13) is inclined at an angle ranging from about 30° to about 60°, preferably from about 40° to about 50°, measured from the central axis (c) of the elongated body (3). Generally, this first outlet port (13) directs the fluid fuel atomizing or dispersing fluid containing oxygen at an angle ranging from about 30° to about 60°, preferably from about 40° to about 50°, measured from the flow direction of the fluid fuel stream ejected from the second outlet port (20). The cross-sectional area of the first outlet port (13), such as cylindrical bores, is smaller than the cross-sectional area of the inner passageway (9) to increase the velocity or the volumetric rate of the fluid fuel atomizing or dispersing fluid containing oxygen. Desirably, each cylindrical bore has a diameter ranging from about 1 mm to about 3 mm, preferably about 2 mm to about 2.5 mm. This particularly designed first outlet port (13) promotes the formation of a substantially homogeneous mixture containing fluid fuel and fluid fuel atomizing or dispersing fluid containing oxygen, e.g., a well or thoroughly mixed mixture containing fluid fuel and fluid fuel atomizing fluid containing oxygen. When the velocity or the volumetric rate of the fluid fuel atomizing or dispersing fluid containing oxygen is increased by reducing the cross-sectional area or diameter of the first outlet port (13), the fluid fuel can be further atomized or dispersed to form a more homogeneous mixture containing the fluid fuel and fluid fuel atomizing or dispersing fluid containing oxygen, e.g., a more thoroughly mixed mixture containing fluid fuel and fluid fuel atomizing fluid containing oxygen. The fluid fuel may be dispersed solely or substantially solely based on the energy generated by the velocity or the volumetric rate of the fluid fuel atomizing or dispersing fluid containing oxygen. Normally, the volumetric rate at sonic velocity of the fluid fuel atomizing or dispersing fluid is at least about 30 $Nm^3/hr$, preferably at about 50 $Nm^3/hr$ to about 70 $Nm^3/hr$. The formation of the substantially homogeneous mixture or homogeneous mixture, e.g., a well mixed or a uniformly mixed mixture containing fine oil droplets and oxygen, within the combustion chamber (17) causes partial combustion of the fluid fuel, with the reduced nitrogen oxides formation. The partial combustion of fluid fuel engenders a flame which is fixed at the tip of the burner. The degree of partial combustion or the temperature resulting from partial combustion can then be regulated or controlled through adjusting the volumetric rate of the fluid fuel atomizing or dispersing fluid containing oxygen. The degree of partial combustion is normally regulated to control the combustion temperature of the partial combustion, as well as the combustion temperature of any subsequent combustion so as to minimize or reduce any detrimental effects on the burner.

The combustion chamber (17) may have a void volume of about 3 $cm^3$ to about 8 $cm^3$, preferably about 6 $cm^3$ to about 7 $cm^3$, in order to accommodate partial combustion of the fluid fuel with the intimately mixed fluid fuel atomizing or dispersing fluid containing oxygen. The combustion chamber (17) has an internal wall surface in the form of a cone or a trumpet end. In other words, the combustion chamber (17) is expanding obliquely toward its discharge end opening (18) to prevent liquid fuel, which may be dripping into the chamber (17) from the second outlet port (20) after termination of combustion, from accumulating inside of the chamber (17). By allowing liquid fuel to flow out of the chamber (17), the liquid fuel is prevented from entering the first outlet port, which is used to emit fluid fuel atomizing or dispersing fluid containing oxygen. Moreover, an angle at which the chamber expands promotes the obtention of the desired flame pattern and length inasmuch as the angle, to some extent, affects the distribution, i.e., the flow configuration, of the fluid fuel and fluid fuel atomizing or dispersing fluid containing oxygen. Desirably, the chamber (17) is expanding at an angle ranging from about 10° to about 30°, preferably from about 12° to about 16°, measured from the longitudinal axis of the first housing means.

The partially combusted fluid fuel leaves the combustion chamber (17) to react with at least a stoichiometric amount of oxidant in at least one subsequent combustion zone, e.g., an area outside of the burner. The oxidant, such as air, oxygen enriched air or pure oxygen, is fed at a pressure of about 0.5 barg to about 1 barg to the subsequent combustion zone through the annular passageway (27). The oxidant leaving the annular passageway (27) envelopes the partially combusted fluid fuel and causes complete combustion of the fluid fuel. The end section of the second annular passageway (27) may be expanded obliquely toward its discharge end opening (29)

in the form of a trumpet end or a cone. The cone or trumpet end shape end section of the second annular passageway (27) is formed by flaring the discharge end section of the second housing means (7) outwardly away from the longitudinal axis of the second housing means at an angle ranging from about 10° to about 30°. This discharge end section covers or surrounds at least a portion of the combustion chamber (17) so that any fluid fuel, such as oil, dripping from the combustion chamber (17) is prevented from entering the second annular passageway (27). Moreover, the conical or trumpet end shape end section of the second annular passageway (27) promotes the obtention of the desired flame pattern and length through imparting the desired flow configuration to the oxidant stream.

During the combustion of the fluid fuel with the fluid fuel atomizing or dispersing means and oxidant, a coolant, such as water or other cooling fluid, is circulated in the cooling jacket (21) and/or the cooling jacket (33) to minimize the effect of the temperature on the burner. The heated coolant is replaced continuously by the cooled coolant.

By particularly ejecting fluid fuel and fluid fuel atomizing or dispersing fluid containing oxygen, the fluid fuel can be effectively and efficiently dispersed and combusted. The energy generated by a fluid fuel atomizing or dispersing fluid containing oxygen, for example, is not only used to disperse the fluid fuel but also used to partially combust the fluid fuel. This partial combustion in turn allows subsequent complete combustion of the fluid fuel to be occurred at a low temperature range. Since partial and complete combustion of the fluid fuel can be carried out at the low temperature range in the presence of a fluid fuel atomizing fluid containing at least 25% oxygen by volume and an oxidant having an oxygen concentration of at least 25% by volume, the fluid fuel can be combusted with the reduced $NO_x$ formation and without substantial damage to the burner.

Although the invention has been described in detail with reference to certain embodiments, those skilled in the art will recognize that there are other embodiments of the invention within the spirit and scope of the claims.

What is claimed is:

1. A process for controlling the combustion temperature and flame length produced by a burner through combusting fluid fuel in at least two combustion zones, said process comprising:

(a) ejecting at least one fluid fuel stream through at least one first outlet opening;

(b) ejecting a fluid fuel atomizing or dispersing fluid containing oxygen at an angle to the flow direction of said at least one fluid fuel stream through at least one second outlet opening;

(c) atomizing or dispersing said at least one fluid fuel stream with said fluid fuel atomizing or dispersing fluid containing oxygen within a chamber;

(d) partially combusting said fluid fuel stream with said fluid fuel atomizing or dispersing fluid containing oxygen in said chamber;

(e) ejecting at least a stoichiometric amount of oxidant through at least one third opening located at a zone downstream of said chamber; and (f) combusting the partially combusted fluid fuel with said oxidant in said zone downstream of said chamber.

2. The process according to claim 1, wherein said fluid fuel stream is a liquid fuel stream or a liquid waste stream having a heating value of at least about 3000 K cal/Kg.

3. The process according to claim 1, wherein said fuel atomizing or dispersing fluid containing oxygen is ejected at an angle ranging from about 30° to about 60°.

4. The process according to claim 1, wherein said at least one fluid fuel atomizing or dispersing fluid containing oxygen is ejected at a volumetric rate of greater than about 30 $Nm^3/hr$.

5. The process according to claim 1, wherein said chamber is located within said burner and wherein said zone downstream of the chamber is located outside of said burner.

6. The process according to claim 1, wherein said at least one fluid fuel atomizing or dispersing fluid containing oxygen is an oxygen-enriched air or technically pure oxygen.

7. The process according to claim 6, wherein said partial combustion of said fluid fuel stream is caused by forming a substantially homogeneous mixture containing said fluid fuel stream and said fluid fuel atomizing or dispersing fluid containing oxygen within said chamber.

8. A burner comprising:

a) an elongated body having at least one inner passageway terminating with at least one first outlet port, said at least one first outlet port being capable of ejecting fluid fuel atomizing or dispersing fluid containing oxygen at an angle with respect to the central axis of said elongated body and having a cross-sectional area smaller than the cross-sectional area of said at least one inner passageway;

b) a first housing means surrounding and extending beyond the length of said elongated body to form a chamber downstream of said at least one first outlet port and to form a first annular passageway therebetween for passing fluid fuel into said chamber, said chamber being capable of accommodating at least partial combustion of fluid fuel; and c) a second housing means surrounding said first housing means to form a second annular passageway therebetween for introducing oxidant downstream of said chamber for further combustion of fluid fuel.

9. The burner according to claim 8, wherein said at least one first outlet port is a plurality of bores at an angle ranging from about 30° to about 60°, measured from the central axis of the elongated body.

10. The burner according to claim 8, wherein said first annular passageway terminates with at least one second outlet port which is defined by at least one spiralling groove on the outer wall surface of said elongated body.

11. The burner according to claim 10, wherein said chamber formed by said first housing means has an internal wall surface in the form of a cone or a trumpet end, said chamber being at least partially surrounded by said second housing means having a discharge end section, said discharge end section having a conical or trumpet end Like internal wall surface which surrounds or covers at least a part of said chamber.

12. The burner according to claim 8, wherein said first annular passageway is in fluid communication with a source containing fluid fuel and wherein said inner passageway is in fluid communication with a source containing fluid fuel atomizing or dispersing fluid containing oxygen.

13. The burner according to claim 8, said first housing means comprises a cooling jacket, said cooling jacket comprising at least one first compartment for receiving cooling fluid from a source outside the cooling jacket and at least one second compartment for receiving and discharging cooling fluid from said at least one first compartment.

14. A burner comprising:

a) an elongated body comprising at least one inner passageway for passing fluid fuel atomizing or dispersing fluid containing oxygen;

b) a first housing means surrounding and extending beyond the length of said elongated body to form a chamber capable of partially combusting fluid fuel and an annular passageway therebetween along the length of said elongated body for passing fluid fuel into said chamber, said chamber having an internal wall surface in the shape of a cone or a trumpet end; and c) a second housing means surrounding said first housing means to form an additional annular passageway for introducing oxidant, said second housing means comprising a discharge end section having an internal wall surface in the form of a cone or a trumpet end, said discharge end section at least partially covering or surrounding said chamber so that any liquid provided in said chamber and said discharge end section is allowed to flow out of said chamber and said discharge end section.

15. The burner according to claim 14, wherein the internal wall surface of said discharge end section are formed by flaring the discharge end section outwardly away from the longitudinal axis of the second housing means at an angle ranging from about 10° to about 30°.

* * * * *